US012467448B1

(12) United States Patent
Wang et al.

(10) Patent No.: US 12,467,448 B1
(45) Date of Patent: Nov. 11, 2025

(54) MULTI-VIBRATOR CONNECTED PIEZOELECTRIC PUMP, OPERATING METHOD AND APPLICATION DEVICE

(71) Applicants: Haiyang Wang, Guangdong (CN); Guojing Xie, Guangdong (CN); Jiebin Gan, Guangdong (CN)

(72) Inventors: Haiyang Wang, Guangdong (CN); Guojing Xie, Guangdong (CN); Jiebin Gan, Guangdong (CN)

(73) Assignee: Shenzhen Baibian Precision Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/824,951

(22) Filed: Sep. 5, 2024

(30) Foreign Application Priority Data

Aug. 26, 2024 (CN) ..... 202411176920.9
Aug. 26, 2024 (CN) ..... 202422072880.5

(51) Int. Cl.
*F04B 43/04* (2006.01)
*F04B 53/16* (2006.01)

(52) U.S. Cl.
CPC ..... *F04B 43/046* (2013.01); *F04B 53/16* (2013.01)

(58) Field of Classification Search
CPC ..... F04B 43/046; F04B 49/22; F04B 43/00; F04B 43/02; F04B 43/026; F04B 43/043; F04B 43/0081; F04B 43/0045; F04B 53/16
See application file for complete search history.

(56) References Cited

U.S. PATENT DOCUMENTS 3,270,672 A * 9/1966 Haines ..... H10N 30/2047 367/160
6,164,933 A * 12/2000 Tani ..... A61B 5/0235 417/440
8,123,502 B2 * 2/2012 Blakey ..... F04B 43/046 92/96
9,217,426 B2 * 12/2015 Wackerle ..... F04B 23/06
9,239,059 B2 * 1/2016 Locke ..... F04B 49/065
10,605,239 B2 * 3/2020 Uruma ..... F04B 43/046
(Continued)

FOREIGN PATENT DOCUMENTS

CN 1399070 A * 2/2003
GB 2575829 A * 1/2020 ..... F04B 45/047
(Continued)

OTHER PUBLICATIONS

English Machine Translation of JP-2007092677-A (Year: 2007).*

*Primary Examiner* — Nathan C Zollinger

(57) ABSTRACT

The invention relates to the technical field of piezoelectric pump, in particular to a multi-vibrator connected piezoelectric pump, an operating method and an application device, comprising a pump body and piezoelectric vibrators arranged in the pump body for fluid transmission. In the invention, a plurality of pump cavities are arranged in the pump body, the piezoelectric vibrator is arranged in each pump cavity, the plurality of piezoelectric vibrators are concentrated into the pump body, and the pump cavities are connected in series or parallel or in series and parallel, so that the pump body can provide large output flow and higher output pressure and greatly reduce the volume of the pump at the same output capacity, facilitating the miniaturization design of the product.

8 Claims, 9 Drawing Sheets

(56) References Cited

U.S. PATENT DOCUMENTS

| | | | | |
|---|---|---|---|---|
| 11,268,506 | B2 * | 3/2022 | Susi | F04B 43/00 |
| 11,391,277 | B2 * | 7/2022 | Tanaka | F04B 45/047 |
| 2005/0225201 | A1 * | 10/2005 | Vogeley | H10N 30/802 310/317 |
| 2019/0192017 | A1 * | 6/2019 | Susi | A61B 5/02141 |
| 2022/0056900 | A1 * | 2/2022 | Okaguchi | F04B 39/121 |

FOREIGN PATENT DOCUMENTS

| | | | | | |
|---|---|---|---|---|---|
| JP | 2007092677 | A | * | 4/2007 | |
| JP | 2011241808 | A | * | 12/2011 | |
| WO | WO-2019230161 | A1 | * | 12/2019 | F16K 15/18 |
| WO | WO-2020188966 | A1 | * | 9/2020 | F04B 39/06 |
| WO | WO-2021079629 | A1 | * | 4/2021 | F04B 23/06 |

* cited by examiner

MULTI-VIBRATOR CONNECTED PIEZOELECTRIC PUMP, OPERATING METHOD AND APPLICATION DEVICE

TECHNICAL FIELD

The invention relates to the technical field of piezoelectric pump, in particular to a multi-vibrator connected piezoelectric pump, an operating method and an application device.

BACKGROUND ART

In the fields of medical device, consumer electronics, pharmaceutical industry, etc., products are developing in the direction of miniaturization. In the field of gas transmission, pumps are key components, of which the piezoelectric micropump is an important branch, which forms positive and negative sound pressures at the check valve under ultrasonic vibration of the piezoelectric vibrator and exhausts gas out of the pump cavity or sucks gas into the pump cavity through the check valve to achieve one-way gas transmission.

However, the existing piezoelectric micropumps are mostly used for pumping trace gases or liquids, and it is difficult to improve the output pressure and flow at the same time. For example, electric breast pumps need to meet the negative pressure above 40 Kp and flow of 1 L/min at the same time. If the output capacity is required to be improved, the usual practice is to connect multiple micropumps in parallel or series to increase the output flow or pressure. However, series or parallel connection through pipelines from the outside of the pump is bound to increase the length of the pipeline, thereby increasing the runner resistance, weakening the output capacity of the pump; moreover, connecting through the external pipeline will increase the overall volume of the pump, which is not conducive to the miniaturization design of the product.

SUMMARY OF THE INVENTION

In order to solve the problems in the background art, the invention provides a multi-vibrator connected piezoelectric pump and an operating method thereof, which increases the output capacity of the pump, and greatly reduces the volume of the pump under the same output capacity, facilitating the miniaturization design of the product.

The invention adopts the following technical proposal to solve the technical problems: A multi-vibrator connected piezoelectric pump comprises a pump body and piezoelectric vibrators arranged in the pump body for fluid transmission, at least two single-layer or laminated pump cavities are arranged in the pump body and are connected in series or parallel or in series and parallel, the piezoelectric oscillators are respectively arranged in the pump cavities and separate the pump cavities into a first cavity connected with a fluid input end and a second cavity connected with a fluid output end, a check valve directly opposite to the center of the piezoelectric oscillator, and a connecting hole for connecting the first cavity with the second cavity is arranged at a non-central point on the surface of the piezoelectric oscillator or the pump body.

Further, the pump body comprises an upper cover and a lower cover provided with a cavity groove on the surface, the upper cover and the lower cover are snap-fitted so that the cavity groove is combined inside the pump body to form a single-layer pump cavity, a fluid channel connected with the pump cavity is arranged on the upper cover and/or lower cover and comprises an input channel and an output channel, and a bulge for increasing the surface area of the pump body to improve the heat dissipation capacity of the pump body is arranged on the surface of the pump body.

Further, a middle cover is arranged between the upper cover and the lower cover, cavity grooves are arranged on both sides of the middle cover, and the upper cover and the lower cover are respectively connected to the end surfaces on both sides of the middle cover, so that the cavity grooves are combined in the pump body to form a laminated pump cavity.

Further, at least two pump cavities are connected in series, a connecting channel for connecting the first cavity of the pump cavity with the second cavity connected with the first cavity in series is arranged between two adjacent single-layer pump cavities connected in series, and the connecting channel is arranged on the upper cover or the lower cover or the middle cover.

Further, at least two pump cavities are connected in parallel, and the pump cavities are respectively connected with the input channel and the output channel.

Further, at least four pump cavities are connected in series and parallel, in which at least two pump cavities are respectively connected with the input channel, and the remaining pump cavities are respectively connected in series with the pump cavities connected in parallel.

Further, the inner wall of the connecting channel is a smooth surface, and the cross-sectional area of a connecting pipe is greater than 1.5 square mm, and the length thereof is less than 80 mm.

Further, the piezoelectric vibrators are respectively equipped with an independent resonance point tracking circuit and an independent power control circuit, and vibrate periodically under the drive of periodic voltage signals above 20 KHz, and the first cavity and the second cavity vibrate through the piezoelectric vibrators to form a positive pressure area and a negative pressure area.

The invention also provides an operating method for a multi-vibrator connected piezoelectric pump, including: the piezoelectric vibrators vibrate periodically under the drive of periodic voltage signals above 20 KHz; the piezoelectric vibrators move towards the second cavity to form a negative pressure area in the first cavity and a positive pressure area in the second cavity and drive the check valve in the first cavity and the check valve in the second cavity to open, so that external fluid flows into one or more pump cavities connected with the input channel for pressurization and then flows into the pump cavity connected with the connecting channel through the connecting channel or is outputted to the output channel.

When the pump cavities are connected in series, the fluid in the input channel flows into the second pump cavity through the connecting channel after being pressurized by the first pump cavity, and the fluid flows into the connecting channel or the output channel after being pressurized by the second pump cavity, thereby achieving an increase in output pressure.

When the pump cavities are connected in parallel, the fluid in the input channel flows into the pump cavities simultaneously through the check valves of the first cavities for pressurization, and then flows into the output channel simultaneously through the check valves of the second cavities to achieve the increase of output flow.

When the pump cavities are connected simultaneously in series and parallel, the fluid in the input channel flows into the pump cavities connected in series simultaneously for pressurization, and is superimposed with the flow in the pump cavities connected in parallel and then outputted to the output channel to achieve the increase of output pressure and output flow at the same time.

The invention also provides an application device, which comprises the multi-vibrator connected piezoelectric pump.

In summary, the invention has the following beneficial effects:

1. In the invention, a plurality of pump cavities are arranged in the pump body, the piezoelectric vibrator is arranged in each pump cavity, the plurality of piezoelectric vibrators are concentrated into the pump body, and the pump cavities are connected in series or parallel or in series and parallel, so that the pump body can provide large output flow and higher output pressure and greatly reduce the volume of the pump at the same output capacity, facilitating the miniaturization design of the product.
2. The invention adopts independent frequency tracking control for each piezoelectric vibrator, so that each piezoelectric vibrator operates at the resonance point, effectively improving the output efficiency of the whole pump body; moreover, the failure of one piezoelectric vibrator will not lead to the failure of the whole pump body, effectively improving the safety.
3. In the invention, check valves are arranged at the input end and the output end of the pump body and face the central position of the piezoelectric vibrator, thereby realizing the one-way fluid transmission, the accurate opening of the check valves during vibration of the piezoelectric vibrator and then the stable one-way fluid transmission.

The above description is only an overview of the technical proposal of the invention. In order to better understand the technical means of the invention, the invention can be implemented according to the contents of the specification; in order to make the above purposes and other purposes, features and advantages of the invention more clearly understood, preferred embodiments are described below in details in combination with the drawings.

Figure 1:
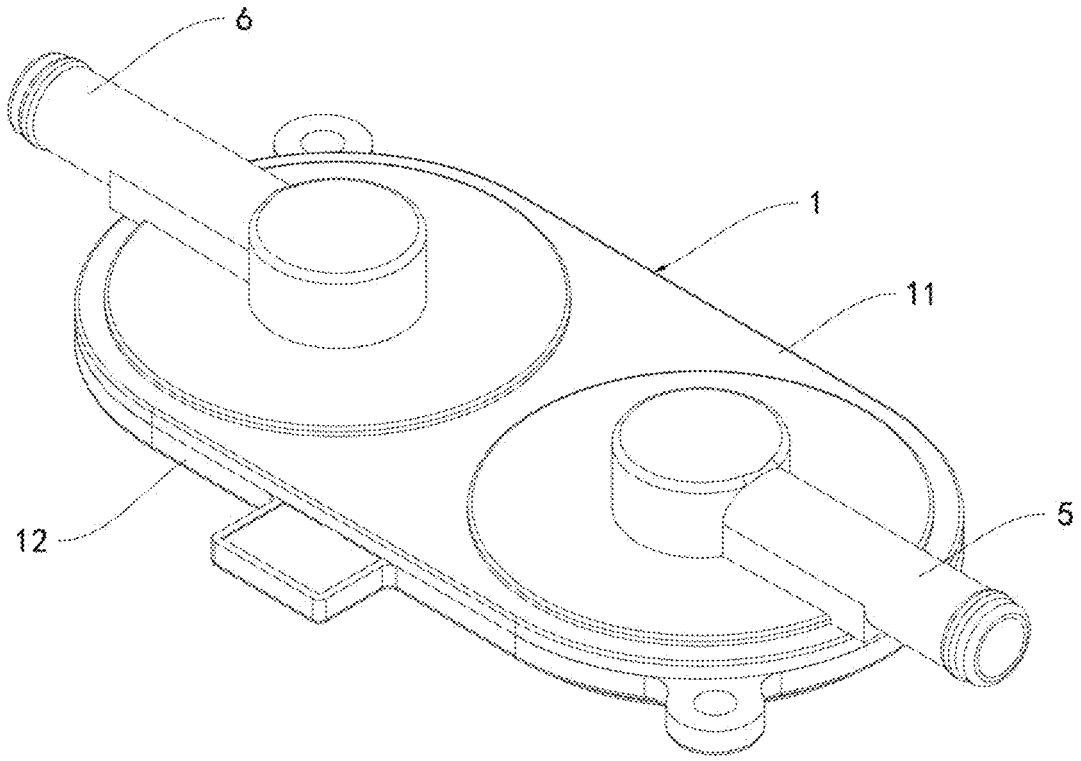
FIG. 1 is the structure diagram of Embodiment 1.

In the drawings: 1. Pump body; 11. Upper cover; 12. Lower cover; 13. Middle cover; 14. Cavity groove; 2. Piezoelectric vibrator; 21. Connecting hole; 3. Pump cavity; 31. First cavity; 32. Second cavity; 4. Check valve; 5. Input channel; 6. Output channel; 7. Connecting channel; 8. Bulge.

DETAILED DESCRIPTION OF THE INVENTION

In order to more easily and clearly understand the content of the invention, the invention is further described according to the embodiments and the drawings.

It should be noted that the orientation or position relationships indicated by the terms herein such as "center", "upper", "lower", "front", "rear", "left", "right", "inner" and "outer" are based on the orientation or position relationships shown in the drawings, and are only intended for facilitating the description of the invention and simplifying the description, but not for indicating or implying that the device or element referred to must have a particular orientation or be constructed and operated in a particular orientation. Therefore, such terms cannot be construed as limitations to the invention. Unless otherwise stated, "a plurality of" means two or more.

Unless otherwise expressly specified and limited, the terms "installed", "interconnected" and "connected" shall be understood in a broad sense. For example, "connected" may be fixedly connected, or detachably connected or integrally connected; "connected" may also be mechanically connected or electrically connected; "connected" may be directly connected, or indirectly connected through an intermediate medium, or connected between two elements. Ordinary technician in the field may understand the specific meanings of the above terms in the invention as the case may be.

As shown in FIG. 1 to FIG. 9, a multi-vibrator connected piezoelectric pump comprises a pump body 1 and a piezoelectric vibrator 2 arranged in the pump body 1. The pump body 1 in the embodiment has a plurality of pump cavities 3 and piezoelectric vibrators 2. The pump cavities 3 are connected in series or parallel or in series and parallel, thereby effectively increasing the overall output flow and pressure of the piezoelectric pump and greatly reducing the volume of pump body 1 to easily realize the miniaturization design of the product. Wherein, the piezoelectric pump in the embodiment comprises at least two pump cavities 3 arranged in the pump body 1, the pump cavities 3 are connected in series or in parallel or in series and parallel, so that the piezoelectric pump in the embodiment can collect the fluid to the same outlet through the pump cavities 3 connected in parallel and then realize flow increase; the pump cavities 3 are connected in series to increase the output pressure of the fluid by transmitting the output fluid through a plurality of piezoelectric vibrators 2; the pump cavities 3 are connected in series into several groups and then connected in parallel to simultaneously increase the output flow and pressure of the pump body 1 in the embodiment.

In the embodiment, the pump cavities 3 can be arranged in a single layer or laminated, wherein, a plurality of pump cavities 3 are arranged on the same plane together, which facilitates the parallel connection of the pump cavities 3 for the pump body 1 of the embodiment; when a plurality of pump cavities 3 are laminated, the output ends of the pump cavities 3 on each layer can be connected in sequence, so that the pump cavities 3 can be connected in series to increase the output pressure of the pump body 1 in the embodiment; in addition, a plurality of pump cavities 3 are arranged in a single layer on the plane and laminated in space at the same time, easily realizing the simultaneous series and parallel connection among the pump cavities 3 of the piezoelectric pump in the embodiment and then realizing the simultaneous increase of output flow and pressure.

In the embodiment, the piezoelectric vibrator 2 is arranged in pump cavity 3, the internal space of the pump cavity 3 is divided into a first cavity 31 connected with the input end of the pump cavity 3 and a second cavity 32 connected with the output end of the pump cavity 3, check valves 4 are arranged at the position where the first cavity 31 is connected with the input end of the pump body 1 and the position where the second cavity 32 is connected with the output end of the pump body 1, so that the sound pressure around the check valve 4*s* on both sides of the piezoelectric vibrator 2 changes when the piezoelectric vibrator 2 vibrates, and then the air pressure of the first cavity 31 and the second cavity 32 changes, so that the check valve 4 in the first cavity 31 and the check valve 4 in the second cavity 32 are opened to realize the one-way fluid transmission.

Specifically, a connecting hole 21 for connecting the first cavity 31 with the second cavity 32 is arranged at a non-central point on the surface of the piezoelectric oscillator 2 or the pump body 1, so that the fluid can be transmitted through the connecting hole 21 on the piezoelectric vibrator 2 inside the pump cavity 3 or transmitted from the outside of the pump body 1 by connecting two connecting holes 21 on the pump body 1 when transmitted from the first cavity 31 to the second cavity 32; in the embodiment, the connecting holes 21 are arranged at the non-central point on the surface of the piezoelectric oscillator 2, so that the pipeline is not required outside the pump body 1 to connect the two connecting holes, thus further reducing the volume of the pump body 1 in the embodiment and facilitating the miniaturization design of the product.

When fluid is transmitted, the piezoelectric vibrators 2 move towards the second cavity 32 to form a negative pressure area in the first cavity 31 and a positive pressure area in the second cavity 32 and drive the check valves 4 in the first cavity 31 and the second cavity 32 to open, so that the fluid enters from the check valve 4 of the first cavity 31, enters the second cavity 32 through the connecting hole 21, and flows from the check valve 4 of the second cavity 32. In the embodiment, the check valve 4 in the first cavity 31 and the check valve 4 in the second cavity 32 are directly opposite to the center of the piezoelectric vibrator 2, so that the check valve 4 in the first cavity 31 and the second cavity 32 can be accurately opened when the piezoelectric vibrator 2 vibrates, thereby realizing rapid and accurate fluid transmission.

It should be noted that the spatial change of the first cavity 31 and the second cavity 32 in the embodiment does not directly generate pressure, but the sound pressure change generated by the high-frequency vibration of the piezoelectric vibrator 22 generates a positive pressure area and a negative pressure area around the check valves 4.

Figure 2:
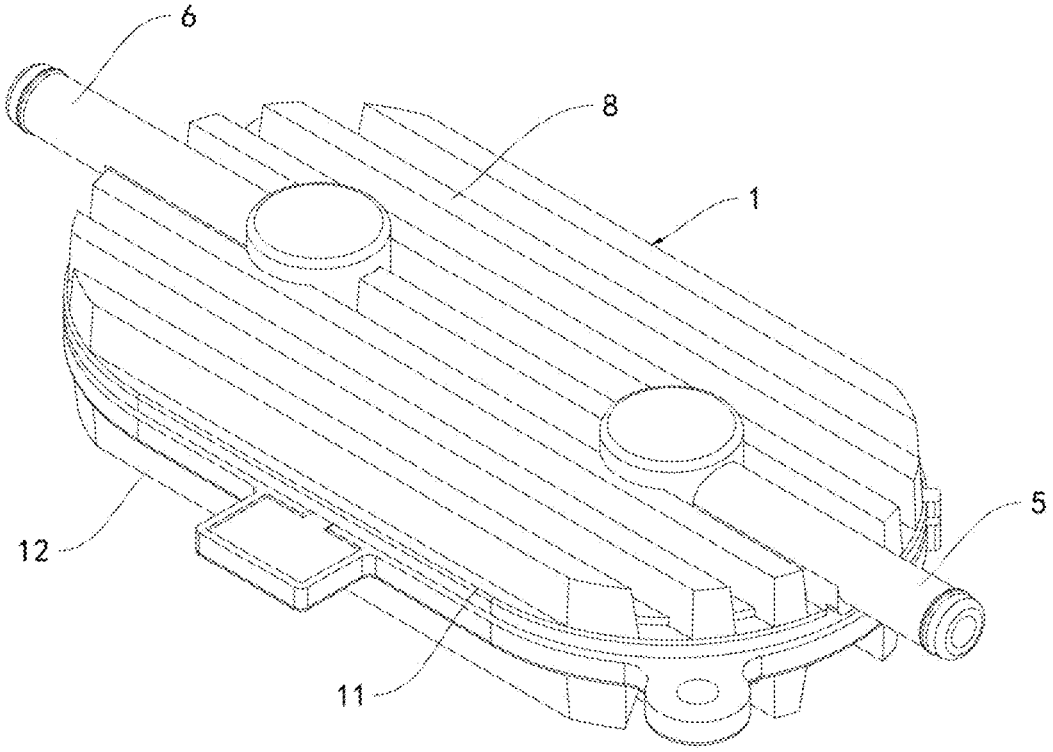
FIG. 2 is the structure diagram of the bulge arranged in Embodiment 1.
Figure 3:
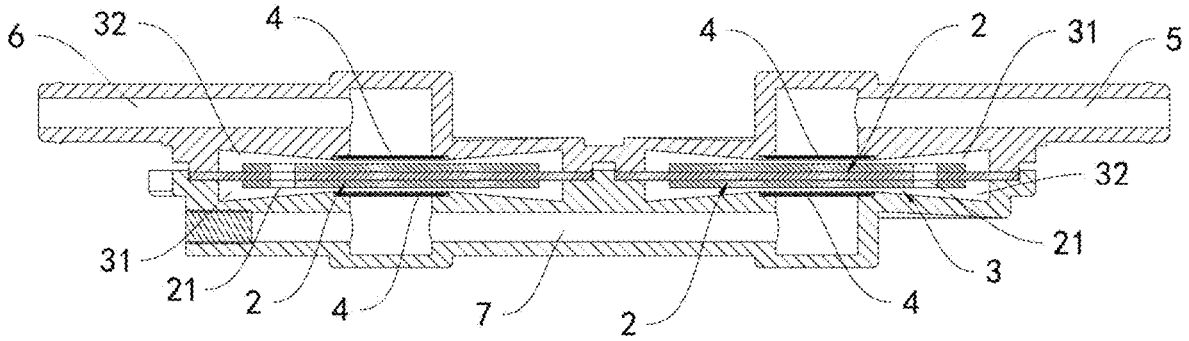
FIG. 3 is the section view of Embodiment 1.

As shown in FIG. 1 to FIG. 3, the pump body 1 in the embodiment comprises an upper cover 11 and a lower cover 12, wherein cavity grooves 14 with corresponding positions are arranged on the surface where the upper cover 11 and the lower cover 12 are connected, so that the cavity grooves 14 for the upper cover 11 and the lower cover 12 can be combined to form the pump cavity 3 after the upper cover 11 and the lower cover 12 are connected; when a plurality of cavity grooves 14 are arranged, a plurality of single-layer pump cavities 3 can be formed in the pump body 1, facilitate the realization of series or parallel or series and parallel connection among the pump cavities. Fluid channels are arranged on the upper cover 11 or lower cover 12 of the embodiment, specifically an input channel 5 for fluid input and an output channel 6 for fluid output, and the fluid channel is connected with one of the pump cavities 3 to realize the fluid transmission. Moreover, in order to facilitate the series connection among the pump cavities 3 arranged in a single layer, a connecting channel 7 is also arranged on the upper cover 11 or lower cover 12 or middle cover 13 of the embodiment, two ends of the connecting channel 7 are respectively connected with two pump cavities thus realizing the series connection between the two pump cavities arranged in a plane and easily increasing the output pressure of the pump body 1 of the embodiment.

Figure 10:
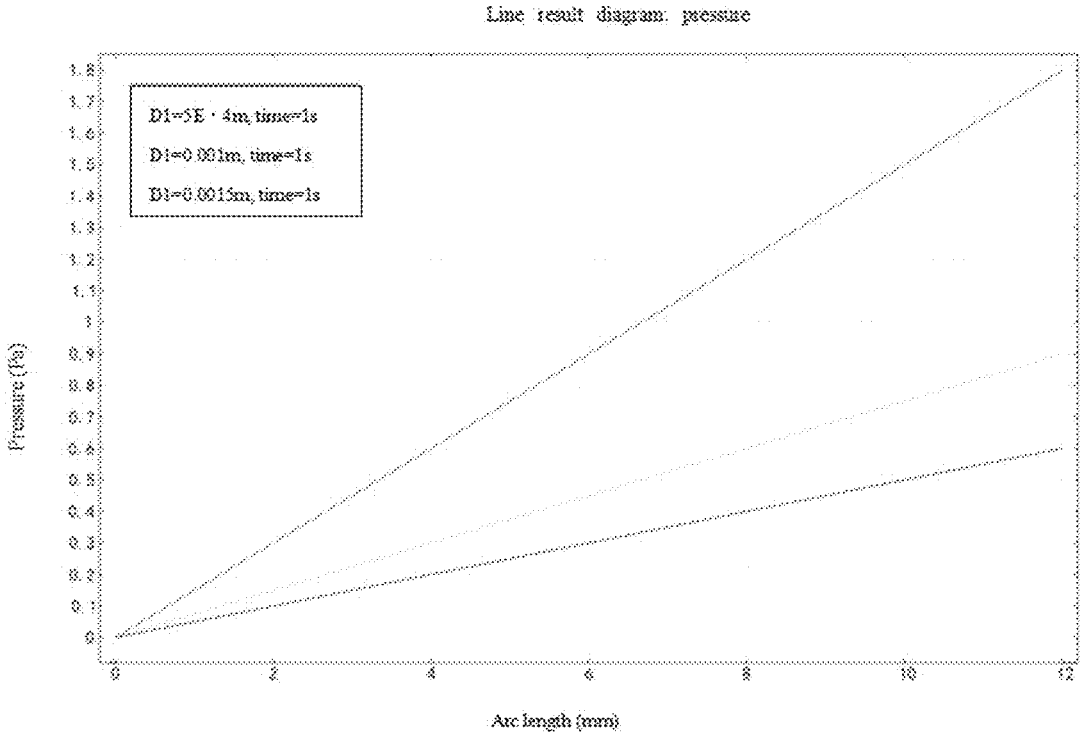
FIG. 10 shows the relationship between the pressure loss of the connecting channel and the length of the pipeline.

As shown in FIG. 10, the pressure losses of three different connecting pipes with radiuses of D1=0.5 mm, D2=1 mm, and D3=1.5 mm are respectively 1.8 Pa, 0.9 Pa and 0.6 Pa at the fluid flow rate of 2 m/s and the travel of 12 mm, and the pressure loss is increased as the length increases, indicating that the length and diameter of the connecting pipe affect the output pressure of the fluid. Therefore, in order to ensure the output pressure of the pump body 1, the inner wall of the connecting pipe in the embodiment is a smooth surface, and the cross-sectional area of the connecting pipe is greater than 1.5 square mm and the length is less than 80 mm, which can reduce the pressure loss and flow resistance of the fluid passing through the connecting channel 7 and enhancing the overall output capacity of the pump body 1 in the embodiment.

As shown in FIG. 4 to FIG. 7, a middle cover 13 is also arranged between the upper cover 11 and the lower cover 12 in the embodiment, wherein cavity grooves 14 are arranged on the surfaces on both sides of the middle cover 13, so that the cavity groove 14 of the upper cover 11 and the cavity groove 14 of the lower cover 12 can be combined with the cavity grooves 14 on both sides of the middle cover 13 respectively to form a laminated pump cavity after the upper cover 11 and the lower cover 12 are connected to the two surfaces of the middle cover 13 respectively; a connecting channel for connecting the surfaces on both sides is arranged in the center of the middle cover 13, so that the two laminated pump cavities 3 can be connected through the connecting channel on the middle cover 13, thereby realizing the series connection between the two laminated pump cavities 3.

Further, as shown in FIG. 2, a plurality of bulges 8 can be arranged on the surface of the pump body 1 in the embodiment, so that the surface area of the pump body 1 can be increased to improve the heat dissipation capacity of the pump body 1 and easily realize good operating effect.

Embodiment 1

As shown in FIG. 1 to FIG. 3, the pump body 1 of the embodiment 1 comprises pump cavities 3, and the two pump cavities 3 are arranged in a single layer and connected in series; a connecting channel 7 for connecting two pump cavities 3 is arranged at the lower cover 12 of the pump body 1, an input channel 5 and an output channel 6 respectively connected with the two pump cavities 3 are arranged at the upper cover 11 of the pump body 1, so that the piezoelectric vibrator 2 of the pump cavity 3 connected with the input channel 5 vibrates downwards when the pump body 1 of the embodiment 1 operates, and then the check valves 4 installed at the input and output ends of the pump cavity 3 are opened, ensuring that the fluid of the input channel 5 enters the first cavity 31 through the check valve 4 and the fluid in the second cavity 32 enters the connecting channel 7 through the check valve 4; the piezoelectric vibrator 2 of the pump cavity 3 connected to the output channel 6 vibrates upwards, ensuring that the fluid in the connecting channel 7 enters the pump cavity 3 through the check valve 4 and is outputted to the output channel 6 through the check valve 4. In the embodiment 1, two pump cavities 3 are connected in series so that the fluid can be transmitted through two piezoelectric vibrators 2, thereby increasing the output pressure.

Embodiment 2

Figure 4:
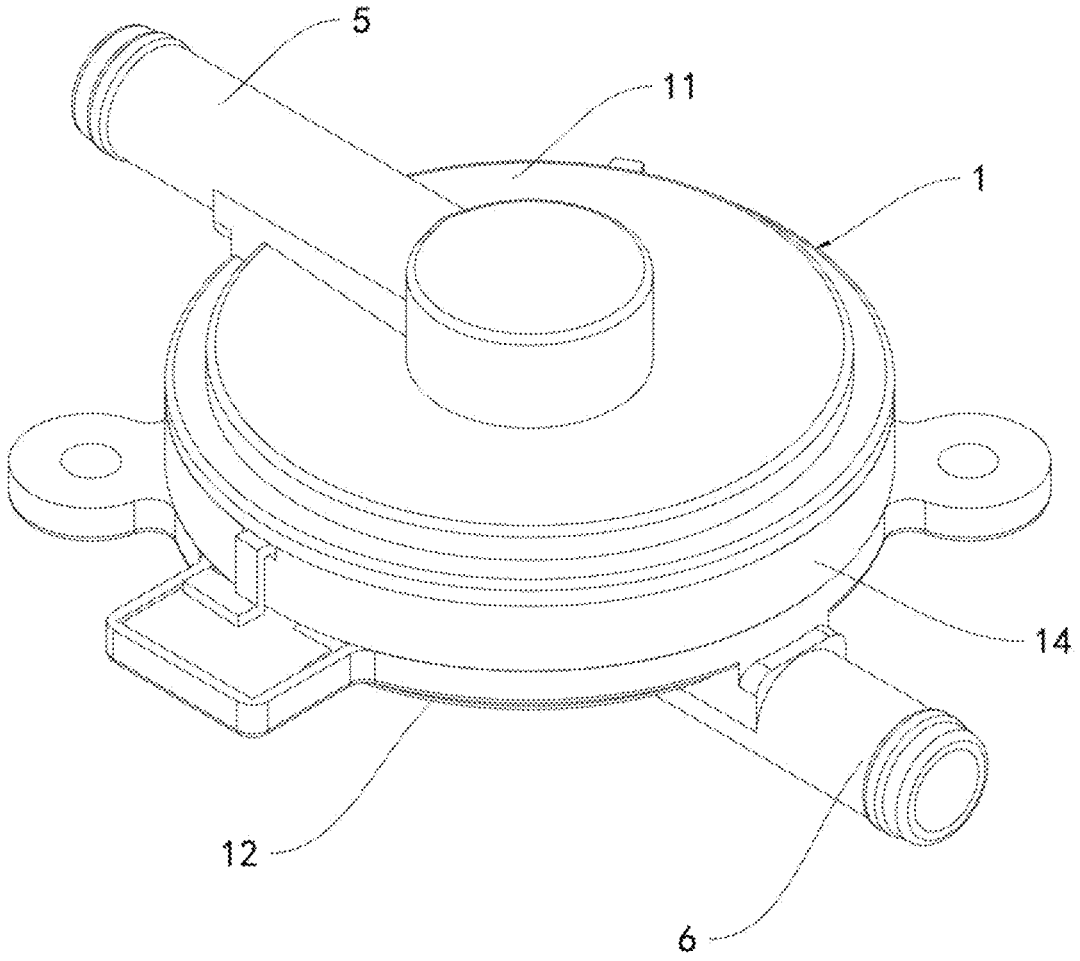
FIG. 4 is the structure diagram of Embodiment 2.
Figure 5:
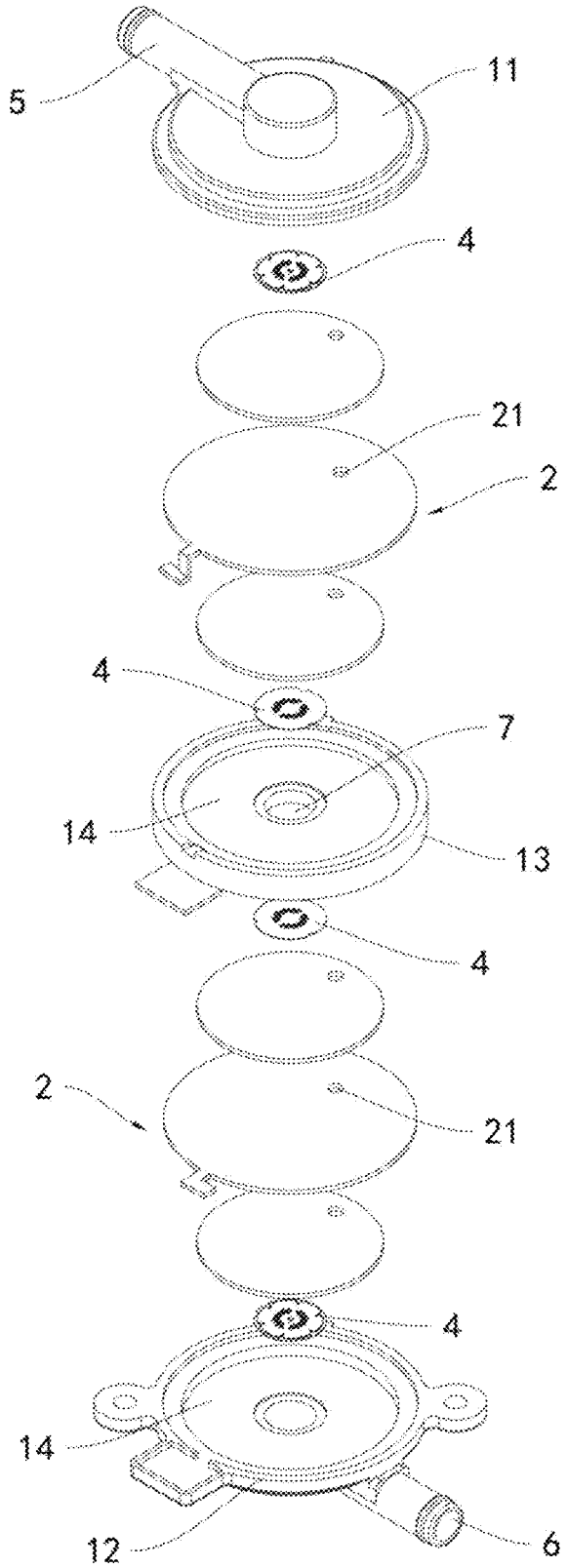
FIG. 5 is the exploded view of Embodiment 2.

As shown in FIG. 4 to FIG. 5, the difference from the embodiment 1 is that the pump cavities 3 of the embodiment 2 are laminated and connected in series, wherein a middle cover 13 is arranged between the upper cover 11 and the lower cover 12 of the pump body 1 in the embodiment 2, and two double-layer laminated pump cavities 3 are formed in the pump body 1 after the upper cover 11 and the lower cover 12 are connected with the middle cover 13. In the embodiment, the upper pump cavity 3 is connected with the input channel 5, the lower pump cavity 3 is connected with the output channel 6, a connecting channel for connecting two pump cavities 3 is arranged at the center of the middle cover 13. Consequently, when the fluid is transmitted, the piezoelectric vibrator 2 in the upper pump cavity 3 vibrates to ensure that the fluid in the input channel 5 enters the first cavity 31 through the check valve 4, and the fluid in the second cavity 32 enters the lower pump cavity 3 through the connecting channel 7; the piezoelectric vibrator 2 in the lower pump cavity 3 vibrates to ensure that the fluid is outputted to the output channel 6, so that the fluid can be pressurized and outputted through the piezoelectric vibrators 2 in the two pump cavities 3, thereby increasing the output pressure of the transmitted fluid.

Embodiment 3

Figure 6:
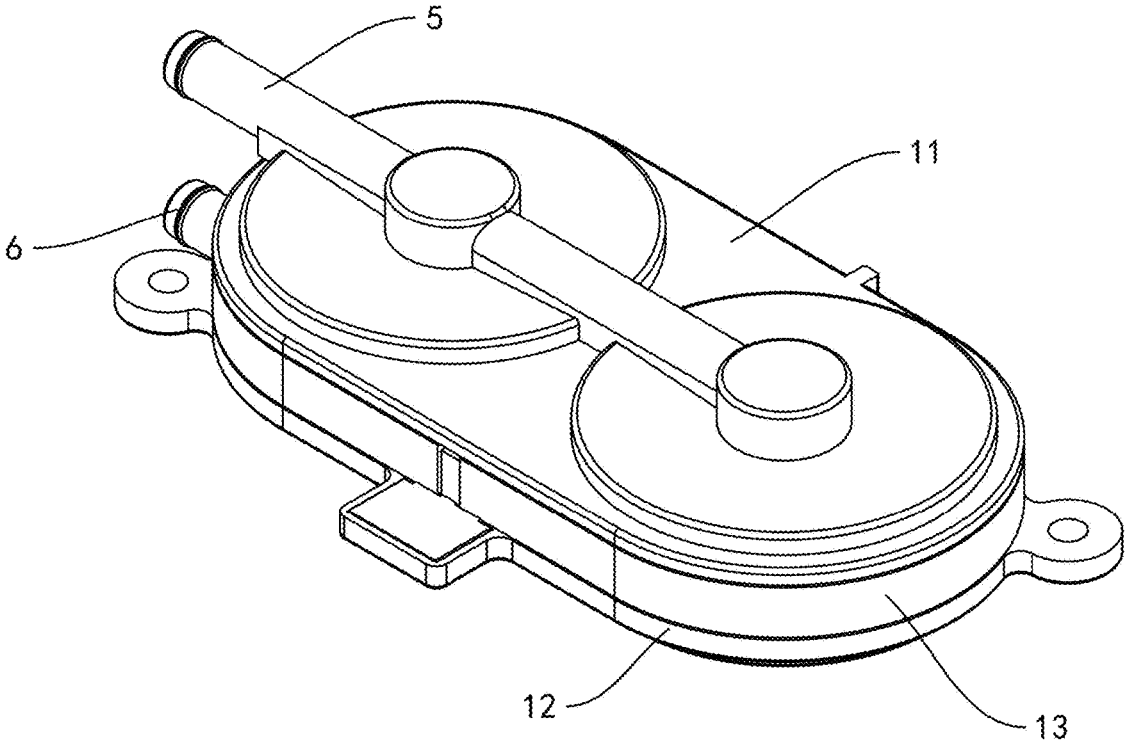
FIG. 6 is the structure diagram of Embodiment 3.
Figure 7:
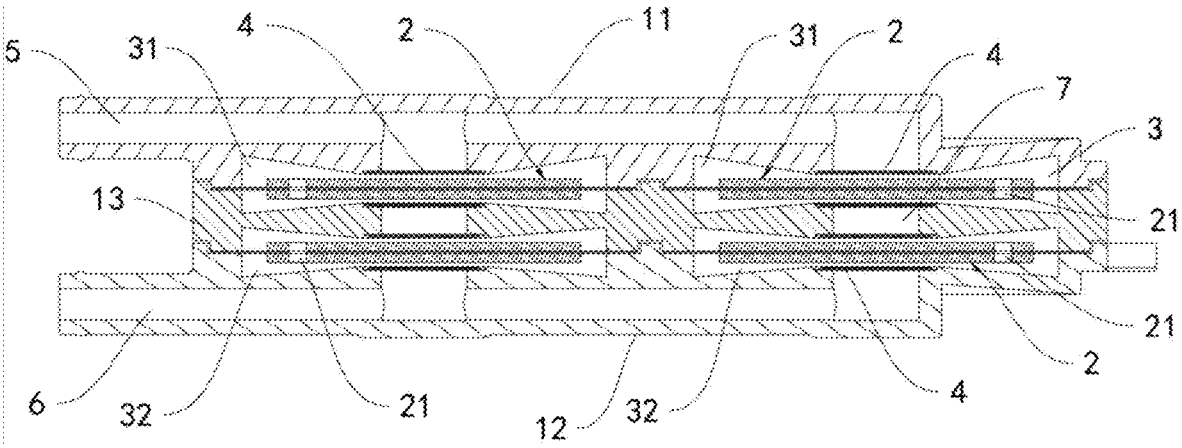
FIG. 7 is the section view of Embodiment 3.

As shown in FIG. 6 to FIG. 7, on the basis of the embodiment 2, a plurality of pump cavities 3 are arranged on each layer in the embodiment, the upper pump cavities 3 are connected with the input channel 5, the lower pump cavities 3 are connected with the input channel 6, and all the pump cavities 3 on the two layers are connected with the corresponding connecting channels on the middle cover 13, that is, the pump cavities 3 on the two layers of the embodiment are connected in series to form a group of cavities connected in series and then connected in parallel, so that the embodiment can increase the output flow and pressure of the fluid simultaneously. Specifically, when the piezoelectric vibrators 2 of the two pump cavities 3 on the upper layer of the embodiment vibrate, the fluid can respectively enter the pump cavity 3 through the input channel 5, and then enter the pump cavities connected in series on the lower layer through the connecting channel at the center of the middle cover 13 to be pressurized and outputted to the output channel 6; the transmitted fluid is pressurized twice through the pump cavities 3 connected in series and then collectively outputted to the output channel 6, thus improving the output flow and pressure of the piezoelectric pump in the embodiment.

Embodiment 4

Figure 8:
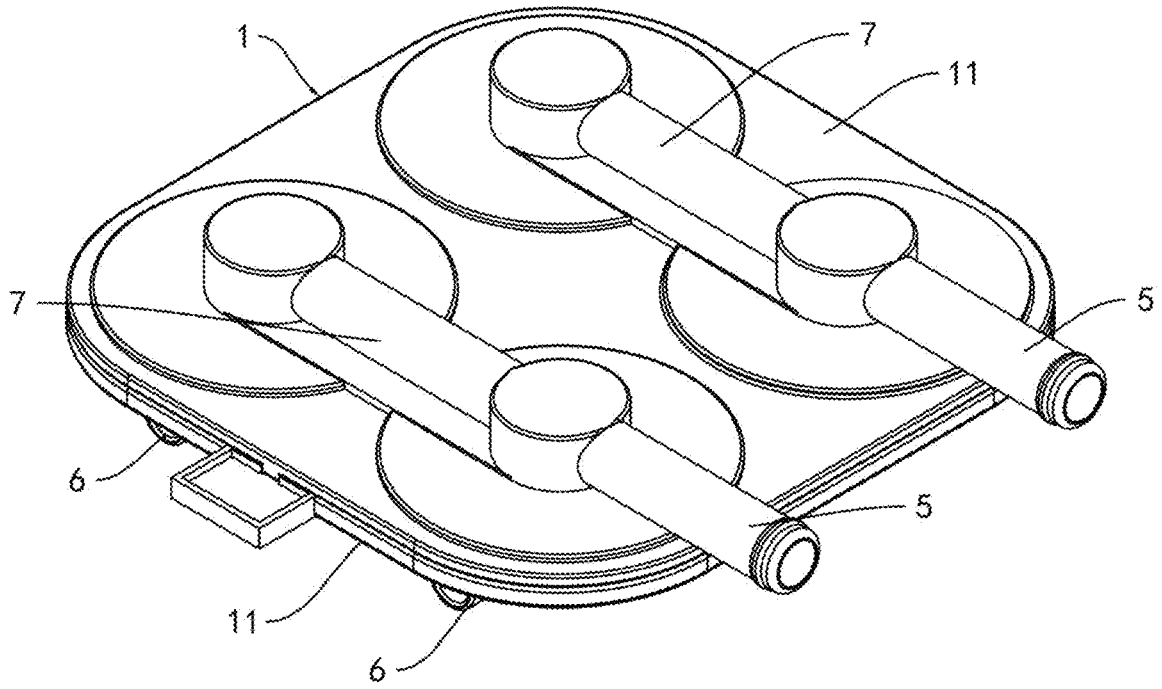
FIG. 8 is the structure diagram of Embodiment 4.
Figure 9:
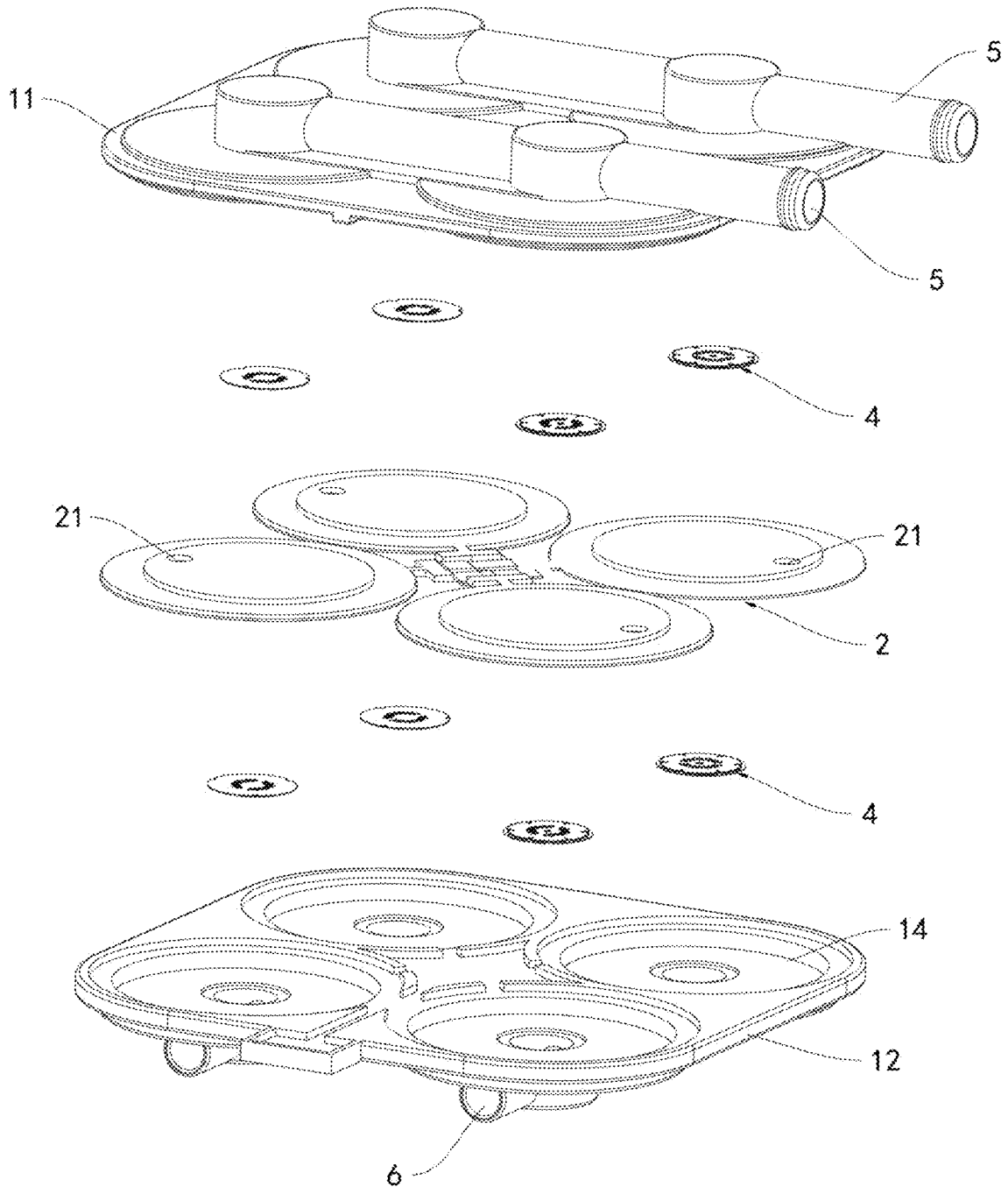
FIG. 9 is the exploded view of Embodiment 4.

As shown in FIG. 8 to FIG. 9, the embodiment 4 a series and parallel connection structure of pump cavities 3, which can effectively increase the output pressure and flow of the pump body 1. Specifically, the pump body 1 of the embodiment 1 is provided with four pump cavities 3 arranged in a single layer, wherein the input end of each pump cavity 3 is connected with the output channel 6, and the output ends of any two pump cavities 3 are connected with the output channel 6 after being connected in series. Consequently, when the fluid is transmitted, the piezoelectric vibrator 2 in the pump cavity 3 vibrates to ensure that the fluid in the input channel 5 respectively enters the pump cavities 3 to be pressurized, and then flows to the output pipeline for confluence through the check valve 4 of the second cavity 32, thereby increasing the overall output flow, and realizing the simultaneous increase of output flow and pressure of the pump body 1.

Embodiment 5

Further, the piezoelectric vibrator 2 of the embodiment vibrate periodically under the drive of periodic voltage signals above 20 KHz, so that the first cavity 31 and the second cavity 32 in the pump cavity 3 vibrate through the piezoelectric vibrators 2 to form a positive pressure area and a negative pressure area respectively. Accordingly, the embodiment can achieve higher pressure and flow simultaneously without relying on the volume change of the pump cavity 3. Moreover, the piezoelectric vibrators 2 operate at the ultrasonic frequency band, and human ears cannot hear the noise. Therefore, the embodiment has the advantages of silence, small size and energy saving.

Figure 11:
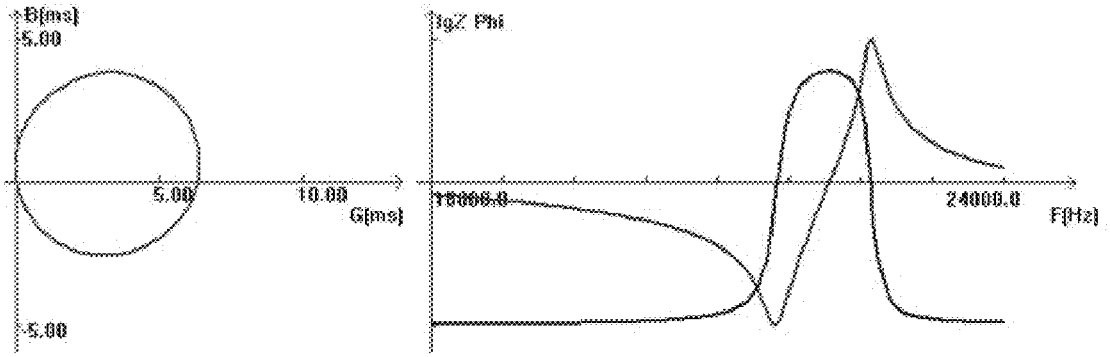
FIG. 11 shows the admittance circle and impedance spectrum of a single piezoelectric vibrator.
Figure 12:
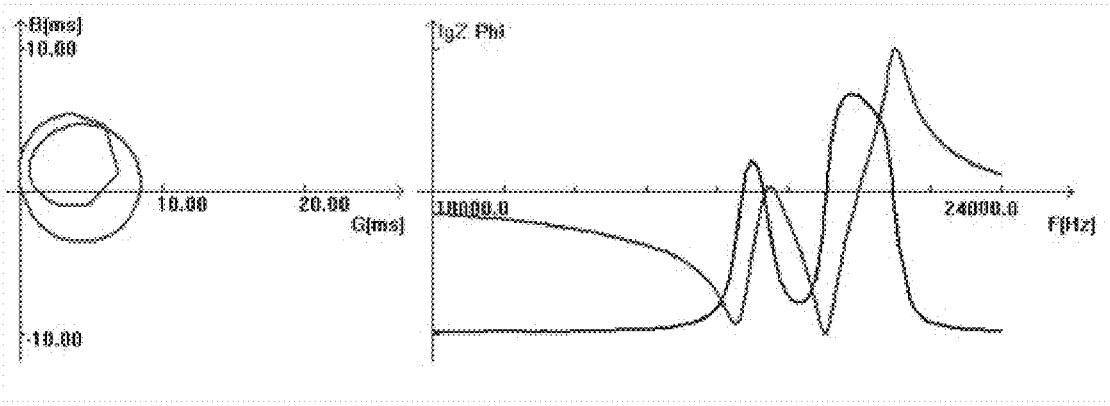
FIG. 12 shows the admittance circle and impedance spectrum of piezoelectric vibrators connected in parallel when the distance between two resonance points is far.
Figure 13:
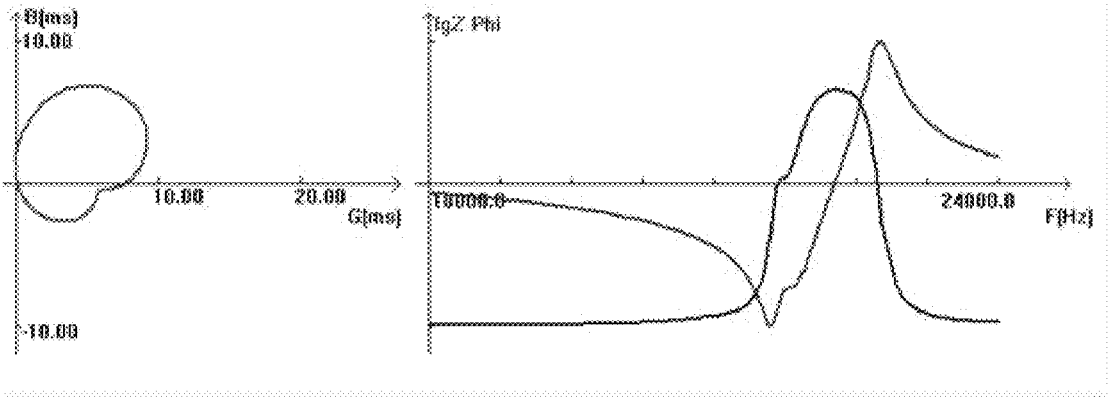
FIG. 13 shows the admittance circle and impedance spectrum of piezoelectric vibrators connected in parallel when the distance between two resonance points is close.

Under normal circumstances, multiple piezoelectric vibrators 2 are driven by one driving circuit. However, as shown in FIG. 11 to FIG. 13, when the driving circuit simultaneously drives multiple parallel piezoelectric vibrators 2, only one frequency point can be tracked, that is, only one piezoelectric vibrator 2 operates at the lowest impedance. Other piezoelectric vibrators 2 cannot operate at the lowest impedance. Especially when the difference between the resonance points of the two piezoelectric vibrators 2 is $f>500$ Hz, the whole pump cannot achieve the optimal output efficiency. Therefore, the piezoelectric vibrators 2 of the pump cavities 3 in the embodiment are respectively provided with independent resonance point tracking circuit and algorithm and independent power control circuit and algorithm. Each piezoelectric vibrator 2 operates at the resonance point, thereby effectively improving the overall output efficiency of the pump. When any of the piezoelectric vibrators 2 fails, the entire pump will not fail, effectively improving the safety.

In the embodiment, the output frequency f and output voltage V of the circuit are controlled in real time through the power control circuit, and the operating current I in the circuit is detected in real time; the output power of the vibrators is controlled through the feedback current and voltage parameters. In addition, a relationship $f=kP^2+bP$ (k and b are two coefficients, multiple sets of data of frequency f and power P are obtained when the current is started, through which the coefficients k and b can be fitted by the least square method) exists between frequency and power. By derivation of the formula, the extreme point of the function can be obtained. The extreme point is the optimum operating point of the current piezoelectric vibrator 2, which is convenient to realize the efficient and stable operation of the piezoelectric vibrator 2.

Specifically, a simultaneous power control circuit of the embodiment includes but is not limited to a boost circuit, and the loop control algorithm is the current loop and voltage loop simultaneous control algorithm, ensuring that the output power is consistent with the power set by the user;

meanwhile, a resonance point tracking circuit of the embodiment includes but is not limited to H-bridge tracking circuit, which has a simple structure and facilitates the realization of resonance point tracking of the vibrators.

Embodiment 6

The embodiment provides an operating method for the piezoelectric pump applicable to the embodiments 1 to 4, including: the piezoelectric vibrators 2 vibrate periodically under the drive of periodic voltage signals above 20 KHz; the piezoelectric vibrators 2 move towards the second cavity 32 to form a negative pressure area in the first cavity 31 and a positive pressure area in the second cavity 32 and drive the check valve 4 in the first cavity 31 and the check valve in second cavity 32 to open, so that external fluid flows into one or more pump cavities 3 connected with the input channel 5 for pressurization and then flows into the pump cavity 3 connected with the connecting channel through the connecting channel or is outputted to the output channel 6.

When the pump cavities 3 are connected in series, the fluid in the input channel 5 flows into the second pump cavity 3 through the connecting channel 7 after being pressurized by the first pump cavity 3, and the fluid flows into the connecting channel 7 or the output channel 6 after being pressurized by the second pump cavity 3, thereby achieving an increase in output pressure.

When the pump cavities 3 are connected in parallel, the fluid in the input channel 5 flows into the pump cavities 3 simultaneously through the check valves of the first cavities 31 for pressurization, and then flows into the output channel 6 simultaneously through the check valves 4 of the second cavities 32 to achieve the increase of output flow.

When the pump cavities 3 are connected simultaneously in series and parallel, the fluid in the input channel 5 flows into the pump cavities 3 connected in series simultaneously for pressurization, and is superimposed with the flow in the pump cavities connected in parallel and then outputted to the output channel 6 to achieve the increase of output pressure and output flow at the same time.

Embodiment 7

The embodiment provides an application device, which comprises the piezoelectric pump in the embodiments 1 to 4. The application device of the embodiment may be, but not limited to, an electric breast pump, a massager, a sphygmomanometer, a smartwatch, etc.

In summary, the operating principle of the embodiment is as follows: In the embodiment, a plurality of pump cavities 3 are arranged in pump body 1, and a piezoelectric vibrator 2 is arranged in each pump cavity 3, so that the plurality of piezoelectric vibrators 2 can be concentrated in one pump body 1; the pump cavities 3 are connected in series or parallel or in series and parallel, so that the pump body 1 can provide large output flow and higher output pressure, and greatly reduce the volume of the pump at the same output capacity, facilitating the miniaturization design of the product.

Moreover, the embodiment adopts independent frequency tracking control for each piezoelectric vibrator 2, so that each piezoelectric vibrator 2 operates at the resonance point, effectively improving the output efficiency of the whole pump body 1; moreover, the failure of one piezoelectric vibrator will not lead to the failure of the whole pump body 1, effectively improving the safety.

Meanwhile, check valves 4 are arranged at the input end and the output end of the pump body 1 and face the central position of the piezoelectric vibrator 2, thereby realizing the one-way fluid transmission, the accurate opening of the check valves 4 during vibration of the piezoelectric vibrator 2 and then the stable one-way fluid transmission.

The above embodiments are only the preferred embodiments of the invention, which are not intended to limit the scope of protection of the invention. Any immaterial changes and modifications made by technicians in the field on the basis of the invention fall within the scope of protection of the invention.

The invention claimed is:

1. A multi-vibrator connected piezoelectric pump, comprising a pump body (1) and piezoelectric vibrators (2) arranged in the pump body (1) for fluid transmission, characterized in that a plurality of pump cavities (3) which are multi-level are arranged in the pump body (1) and are connected in series or parallel or in series and parallel, the piezoelectric vibrators (2) are respectively arranged in the pump cavities (3) and separate the pump cavities (3) into a first cavity (31) located at a fluid input end and a second cavity (32) located at a fluid output end, check valves (4) directly opposite to the center of the piezoelectric vibrators (2), and a connecting hole (21) for connecting the first cavity (31) with the second cavity (32) is arranged at a non-central point on a surface of the piezoelectric vibrators (2);

wherein the pump body (1) comprises an upper cover (11) and a lower cover (12) which are provided with cavity grooves (14) on a surface of the upper cover (11) and the lower cover (12), the upper cover (11) and the lower cover (12) are snap-fitted so that the cavity grooves (14) are inside the pump body (1) to form pump cavities (3), fluid channels connected with the pump cavities (3) are arranged on the pump body (1) and comprise an input channel (5) and an output channel (6), and a bulge for increasing the surface area of the pump body (1) to improve the heat dissipation capacity of the pump body (1) is arranged on a surface of the pump body (1);

a middle cover (13) is arranged between the upper cover (11) and the lower cover (12), additional cavity grooves (14) are arranged on both sides of the middle cover (13), and the upper cover (11) and the lower cover (12) are respectively connected to end surfaces on both sides of the middle cover (13), so that the cavity grooves (14) are combined in the pump body (1) to form pump cavities (3) which are multi-level.

2. The multi-vibrator connected piezoelectric pump according to claim 1, characterized in that at least two pump cavities (3) are connected in series, a connecting channel (7) for connecting the first cavity (31) to the second cavity (32) is arranged between two adjacent single-layer pump cavities (3) connected in series, and the connecting channel (7) is arranged on the upper cover (11) or the lower cover (12) or the middle cover (13).

3. The multi-vibrator connected piezoelectric pump according to claim 1, characterized in that the pump cavities (3) are connected in parallel, and the pump cavities (3) are respectively connected with the input channel (5) and the output channel (6).

4. The multi-vibrator connected piezoelectric pump according to claim 1, characterized in that at least four pump cavities (3) are connected in series and parallel, in which at least two pump cavities (3) are respectively connected with the input channel (5), and the remaining pump cavities (3) are respectively connected in series with the pump cavities (3) connected in parallel.

5. The multi-vibrator connected piezoelectric pump according to claim 2, characterized in that an inner wall of the connecting channel (7) is a smooth surface, and a cross-sectional area of the connecting channel (7) is greater than 1.5 square mm and is less than or equal to 10 square mm, and the length thereof is less than 80 mm.

6. The multi-vibrator connected piezoelectric pump according to claim 2, characterized in that the piezoelectric vibrators (2) are driven by the same drive circuit and vibrate periodically under the drive of periodic voltage signals of the drive circuit, and the piezoelectric vibrators (2) vibrate within the first cavity (31) and the second cavity (32) to form a positive pressure area and a negative pressure area.

7. An operating method for the multi-vibrator connected piezoelectric pump according to claim 6, characterized by including the following steps:

the piezoelectric vibrators (2) vibrate periodically under the drive of periodic voltage signals above 20 KHz;

the piezoelectric vibrators (2) move towards the second cavity (32) to form a negative pressure area in the first cavity (31) and a positive pressure area in the second cavity (32) and drive the check valve (4) in the first cavity (31) and the check valve (4) in the second cavity (32) to open, so that external fluid flows into one or more pump cavities (3) connected with the input channel (5) for pressurization and then flows into the pump cavity (3) connected with the connecting channel through the connecting channel or is outputted to the output channel (6);

when the pump cavities (3) are connected in series, after being pressurized by one pump cavity (3) among the pump cavities (3) the fluid in the input channel (5) flows into another pump cavity (3) among the pump cavities (3) through the connecting channel (7), and the fluid flows into the output channel (6) after being pressurized by the another pump cavity (3) among the pump cavities (3), thereby achieving an increase in output pressure;

when the pump cavities (3) are connected in parallel, the fluid in the input channel (5) flows into the pump cavities (3) simultaneously through the check valves of the first cavities (31) for pressurization, and then flows into the output channel (6) simultaneously through the check valves (4) of the second cavities (32) to achieve the increase of output flow;

when the pump cavities (3) are connected simultaneously in series and parallel, the fluid in the input channel (5) flows into the pump cavities (3) connected in series simultaneously for pressurization, and is superimposed with the flow in the pump cavities connected in parallel and then outputted to the output channel (6) to achieve the increase of output pressure and output flow at the same time.

8. An application device, characterized by comprising the multi-vibrator connected piezoelectric pump in claim 1.

* * * * *